US008987664B2

(12) United States Patent
Sugawara

(10) Patent No.: US 8,987,664 B2
(45) Date of Patent: Mar. 24, 2015

(54) MASS SPECTROMETRY DEVICE

(71) Applicant: Shimadzu Corporation, Kyoto-shi, Kyoto (JP)

(72) Inventor: Hiroshi Sugawara, Kyoto (JP)

(73) Assignee: Shimadzu Corporation, Kyoto (JP)

( * ) Notice: Subject to any disclaimer, the term of this patent is extended or adjusted under 35 U.S.C. 154(b) by 0 days.

(21) Appl. No.: 13/761,933

(22) Filed: Feb. 7, 2013

(65) Prior Publication Data

US 2014/0217280 A1 Aug. 7, 2014

(51) Int. Cl.

*H01J 49/24* (2006.01)
*H01J 49/02* (2006.01)
*H01J 49/00* (2006.01)

(52) U.S. Cl.

CPC ..... *H01J 49/24* (2013.01); *H01J 49/005* (2013.01)
USPC ..... 250/289; 250/281; 250/288

(58) Field of Classification Search

CPC ..... H01J 49/24; H01J 49/005
USPC ..... 250/281, 288, 289
See application file for complete search history.

(56) References Cited

U.S. PATENT DOCUMENTS

| | | | | |
|---|---|---|---|---|
| 3,867,631 | A * | 2/1975 | Briggs et al. | 250/288 |
| 4,889,995 | A * | 12/1989 | Tsutsumi et al. | 250/289 |
| 7,385,185 | B2 * | 6/2008 | Dowell et al. | 250/281 |
| 8,299,427 | B2 | 10/2012 | Mukaibatake | |
| 8,669,518 | B2 * | 3/2014 | Ishiguro et al. | 250/282 |
| 2004/0245449 | A1 * | 12/2004 | Nakashige et al. | 250/281 |
| 2005/0178963 | A1 * | 8/2005 | Londry et al. | 250/293 |
| 2009/0095898 | A1 * | 4/2009 | Collings et al. | 250/281 |
| 2009/0194679 | A1 * | 8/2009 | Doherty et al. | 250/288 |
| 2010/0108879 | A1 * | 5/2010 | Bateman et al. | 250/281 |
| 2010/0213363 | A1 * | 8/2010 | Nakajima et al. | 250/281 |
| 2011/0100097 | A1 * | 5/2011 | Gerdau et al. | 73/40.7 |
| 2011/0315869 | A1 * | 12/2011 | Ishiguro et al. | 250/288 |
| 2013/0043380 | A1 * | 2/2013 | Correale | 250/288 |

FOREIGN PATENT DOCUMENTS

| | | | |
|---|---|---|---|
| JP | 06-203790 | | 7/1994 |
| JP | 2000-036283 | A | 2/2000 |
| JP | 2000036283 | A * | 2/2000 |
| WO | 2008/090600 | A1 | 7/2008 |

OTHER PUBLICATIONS

Japanese Office Action dated Aug. 29, 2013 issued in Japanese Patent Application No. 2010-184648.

* cited by examiner

*Primary Examiner* — Jack Berman
*Assistant Examiner* — Wyatt Stoffa
(74) *Attorney, Agent, or Firm* — Sughrue Mion, PLLC

(57) ABSTRACT

Vacuum gauges are arranged in intermediate vacuum chamber and analytical chamber 10 in which collision cell is installed, and gas pressure determination unit determines whether or not the gas pressures detected by vacuum gauges are at or below a threshold value prior to analysis, and issues an alert if they are at or below the threshold value. If the supply of CID gas into collision cell stagnates, the quantity of CID gas flowing out into the analytical chamber will decrease, and the degree of vacuum in the analytical chamber will thus become too high. Furthermore, if the heated capillary becomes clogged, the quantity of gas flow into the intermediate vacuum chamber from the ionization chamber, which has an ambient pressure atmosphere, will decrease, and thus the degree of vacuum inside the intermediate vacuum chamber will become too high.

1 Claim, 2 Drawing Sheets

MASS SPECTROMETRY DEVICE

JP Patent Application No. 2010-184648, filed Aug. 20, 2010, is herein incorporated by reference in its entirety.

TECHNICAL FIELD

The present invention relates to a mass spectrometry apparatus, more specifically, to abnormality detection technology for detecting abnormalities occurring during analysis using a mass spectrometry apparatus.

BACKGROUND ART

In a mass spectrometry apparatus, a mass analyzer which separates ions originating from a sample according to mass-charge ratio and a detector which detects the ions are disposed inside an analytical chamber evacuated to a vacuum by means of a high performance vacuum pump such as a turbomolecular pump. Generally, performing analysis in a state where the degree of vacuum inside the analytical chamber is not sufficiently high not only does not allow the analysis to be performed with sufficient sensitivity and precision, but also leads to contamination of the mass analyzer, detector and the like. Thus, in a conventional mass spectrometry apparatus, a vacuum gauge such as an ion gauge which monitors the degree of vacuum is additionally provided in the analytical chamber, and the monitored value for the degree of vacuum (pressure) provided by this vacuum gauge is displayed on an indicator (see Patent Literature 1, etc.). When analysis is to be performed, the analyst can check the displayed value, and if the gas pressure is higher than a certain threshold value, the analyst can judge that the vacuum evacuation is still inadequate and not perform the analysis. Furthermore, in the mass spectrometry apparatus described in Patent Literature 1, control is implemented to provide abnormality annunciation to alert the analyst in case the degree of vacuum drops during analysis.

Furthermore, in a mass spectrometry apparatus using an ambient pressure ion source, such as an electrospray ion source, a multistage differential evacuation system is employed, in which one or multiple intermediate vacuum chambers are arranged between the ionization chamber, which has a near-ambient pressure atmosphere, and the analytical chamber, which has a high vacuum atmosphere. In this sort of mass spectrometry apparatus, a vacuum gauge, such as a Pirani gauge, is provided not just in the analytical chamber but also in the intermediate vacuum chamber, which is evacuated to a vacuum by means of a rotary pump, for example, and has a relatively low degree of vacuum, and the monitored value for the degree of vacuum in the intermediate vacuum chamber is also displayed on the indicator. Therefore, the analyst is able to check the degree of vacuum not just in the analytical chamber but also in the intermediate vacuum chamber, and perform analysis in a state where an adequate degree of vacuum has been secured.

A conventional mass spectrometry apparatus as described above has a function which allows one to avoid performing inappropriate analysis in a state where the degree of vacuum is lower than the target state by monitoring the degree of vacuum in the intermediate vacuum chamber and analytical chamber. However, there are cases where the expected signal strength cannot be obtained and the analytical sensitivity and precision are low even though the degree of vacuum of the intermediate vacuum chamber and analytical chamber is adequately high. Of course, while there are various causes for being unable to obtain adequate signal strength in a mass spectrometry apparatus, the cause may involve the following problems with the apparatus.

(1) In an ambient pressure ionization mass spectrometry apparatus using a multistage differential evacuation system, in order to ensure the degree of vacuum in chambers with a higher degree of vacuum, a configuration is used wherein ions are transported to the next stage through an ion inlet unit (heated capillary, skimmer, etc.) with a very small diameter. Liquid drops caused by inadequate gasification of solvent may fly into the ion inlet unit, and clogging of the ion inlet unit occurs relatively easily. If the ion inlet unit becomes clogged, it becomes impossible to transport ions to the next stage, and the signal strength of the finally detected ions decreases.

(2) In MS/MS type mass spectrometry apparatus using a collision cell for dissociating ions through collision induced dissociation (CID), if adequate supply of CID gas such as argon into the collision cell becomes impossible due to the occurrence of gas leaks in the pipeline which supplies the CID gas or abnormalities in the operation of the gas supply valve, it will become more difficult for product ions to be produced in the collision cell. In such cases, however many precursor ions are introduced into the collision cell, the signal strength of the finally detected product ions will decrease.

PRIOR ART LITERATURES (PATENT LITERATURE 1) Japanese Unexamined Patent Application Publication 2000-36283

SUMMARY OF THE INVENTION

The present invention was made to resolve the aforementioned problems, its object being to provide a mass spectrometry apparatus which automatically checks for problems such as those described above, which are mainly due to problems with the apparatus or inadequate maintenance, at the time of analysis, and makes it possible to conduct analysis with the apparatus being in good condition.

The first invention, made to resolve the aforementioned problem, is a mass spectrometry apparatus comprising a vacuum chamber which is evacuated to a vacuum; an operating area which communicates with said vacuum chamber and holds gases supplied from outside for the purpose of performing predetermined operations on ions prior to mass spectrometry; and a mass analyzer which separates ions which have undergone operations in said operation area according to their mass-charge ratio and a detector which detects the separated ions, which are installed inside said vacuum chamber, said mass spectrometry apparatus being characterized in that it comprises:

a) a pressure detection means which detects gas pressure inside said vacuum chamber; and b) an abnormality determination means which, in the event that the gas pressure detected by said pressure detection means prior to execution of analysis is at or below a predetermined threshold value, deems that there is an abnormality in the gas supply to said operation area and issues an alert.

A typical mode of the first invention can have a configuration wherein said operation area is a collision cell installed inside said vacuum chamber for dissociating ions by causing the ions to collide with a predetermined gas, said mass analyzer is a back end mass analyzer which separates product ions generated in said collision cell according to mass-charge ratio, and an additional front end mass analyzer which selects precursor ions having a specific mass-charge ratio from among the various ions and feeds them into said collision cell is provided on the front end of said collision cell.

Furthermore, in another mode, said operation area can be made into an area wherein the ions are cooled by colliding the ions with a predetermined gas and are held temporarily.

For example, in a mass spectrometry apparatus according to the aforementioned typical mode, a predetermined gas is supplied into the collision cell, and if the gas has been filled into the cell to a certain degree, the gas pressure within the vacuum chamber will tend to rise under the influence of gas flowing out from the cell. On the other hand, when some sort of problem occurs with the supply of gas into the collision cell, the quantity of gas flowing out from the cell into the vacuum chamber decreases and the gas pressure inside the vacuum chamber decreases relatively. The abnormality determination means receives the value of gas pressure inside the vacuum chamber detected by the pressure detection means prior to execution of analysis, and determines if this detected value is at or below a predetermined threshold. If the detected gas pressure value is at or below the threshold, i.e. if it is too low, it is judged that there is an abnormality in the supply of gas to the collision cell, and an alert is issued for example by means of display or sound. As a result, the analyst can quickly take the appropriate measures, such as checking the parts associated with supply of gas into the collision cell, repairing the apparatus, filling with more gas, etc.

Furthermore, the second invention made to resolve the aforementioned problem is a mass spectrometry apparatus with a multistage differential evacuation system, comprising an ambient pressure ion source which ionizes a sample in an ambient pressure atmosphere; a mass analysis unit which separates and detects ions according to mass-charge ratio; at least one ion transport optical system which transports ions from said ambient pressure ion source to said mass analysis unit; an ionization chamber which has a near-ambient pressure atmosphere and encloses said ambient pressure ion source; an analysis chamber which has a high vacuum atmosphere and encloses said mass analysis unit; one or multiple intermediate vacuum chambers which are disposed between said ionization chamber and said analytical chamber and enclose said ion transport optical system; and an ion inlet unit for transporting ions from said ionization chamber to the next stage intermediate vacuum chamber, characterized in that it comprises a) a pressure detection means which detects gas pressure inside said next stage intermediate vacuum chamber; and b) an abnormality determination means which, in the event that the gas pressure detected by said pressure detection means prior to execution of analysis is at or below a predetermined threshold value, deems that there is an abnormality in ion introduction via said ion inlet unit and issues an alert.

In the mass spectrometry apparatus with a multistage differential evacuation system according to the second invention, gas flow occurs from the ionization chamber into the next stage intermediate vacuum chamber due to pressure difference at both ends of the ion inlet unit, and ions are transported by being carried by this gas flow. If the ion inlet unit becomes clogged for whatever reason, the gas flow will stagnate, and thus the quantity of gas flowing into the next stage intermediate vacuum chamber will decrease and the gas pressure inside the intermediate vacuum chamber will fall relatively. The abnormality determination means receives the detected value of gas pressure inside the vacuum chamber detected by the pressure detection means prior to execution of analysis, and determines if this detected value is at or below a predetermined threshold. If the detected gas pressure value is at or below the threshold, i.e. if it is too low, it is judged that there is an abnormality in the flow of gas through the ion inlet unit, and an alert is issued for example by means of display or sound. As a result, the analyst can quickly take the appropriate measures, such as checking for the presence of clogging of the ion inlet unit and cleaning or replacing parts as necessary.

In the first invention and second invention, the threshold value for evaluating the gas pressure detected by the pressure detection means can be a value predetermined by the apparatus manufacturer, etc., or a value set by through input by the user.

Furthermore, in an MS/MS type mass spectrometry apparatus having an ambient pressure ion source, it is obvious that the first invention and second invention can be used together.

With the mass spectrometry apparatus according to the first invention, apparatus abnormalities such as gas leaks in the pipeline which supplies CID gas into the collision cell, operational abnormalities of gas supply values and running out of gas are checked for automatically prior to analysis. As a result, it becomes possible to prevent the execution of analysis in a state where such apparatus abnormalities remain and the useless collection of improper data. Furthermore, it becomes possible to quickly take measures to resolve apparatus abnormalities such as those discussed above.

Furthermore, with the mass spectrometry apparatus according to the second invention, apparatus abnormalities such as clogging of the ion inlet unit are checked for automatically prior to analysis. As a result, it becomes possible to prevent the execution of analysis in a state where such apparatus abnormalities remain and the useless collection of improper data. Furthermore, it becomes possible to quickly take measures to resolve apparatus abnormalities such as those discussed above.

DETAILED DESCRIPTION OF THE EXEMPLARY EMBODIMENTS

Figure 1:
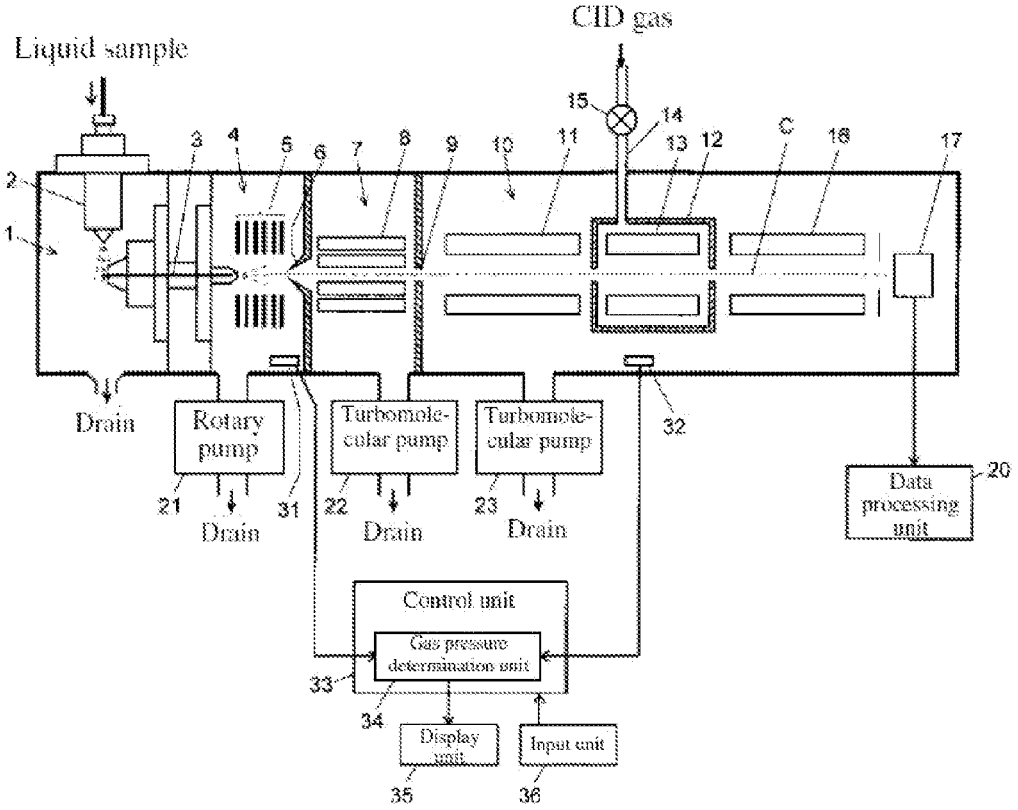
FIG. 1 An overall diagram of an MS/MS type mass spectrometry apparatus according to an example of embodiment of the present invention.

An MS/MS type mass spectrometry apparatus which is an example of embodiment of the present invention will be described with reference to the appended drawings. FIG. 1 is an overall diagram of an MS/MS type ambient pressure ionization mass spectrometry apparatus.

In FIG. 1, a first intermediate vacuum chamber 4 which is evacuated to a low vacuum atmosphere by a rotary pump 21 and a second intermediate vacuum chamber 7 which is evacuated to a medium vacuum atmosphere by a separate turbomolecular pump 22 are disposed between ionization chamber 1, which has a near-ambient pressure atmosphere, and analytical chamber 10, which is evacuated to a high vacuum atmosphere by a high performance turbomolecular pump 23, forming a multistage differential evacuation system configuration in which the degree of vacuum becomes higher (the gas pressure becomes lower) in stepwise fashion in the direction of travel of ions. A liquid sample containing a sample component is sprayed into the ionization chamber 1 while being imparted with a charge from electrospray nozzle 2. The sprayed charged liquid drops come into contact with the surrounding air and are reduced in size and the solvent evaporates, and in this process the sample component is ionized. It will be noted that ionization based on ambient pressure ionization, ambient pressure optical ionization or other ambient pressure ionization techniques may be performed instead of electrospray ionization.

Ionization chamber 1 and first intermediate vacuum chamber 4 are connected to each other by a small diameter heated capillary 3 (corresponding to the ion inlet unit of the present invention), and ions generated in the ionization chamber 1 are sucked inside the heated capillary 3 due to the pressure difference at the two open ends of the heated capillary 3. Then, the ions are discharged into the first intermediate vacuum chamber 4 along with the flow of gas containing air, gasified solvent, etc. flowing into the first intermediate vacuum chamber 4 from ionization chamber 1. A first ion guide 5 which focuses ions by means of a high frequency magnetic field is installed inside the first intermediate vacuum chamber 4, the ions discharged from the exit end of heated capillary 3 are focused by the first ion guide 5, and are fed into the second intermediate vacuum chamber 7 through an orifice formed in the top of skimmer 6. In this example, the first ion guide 5 has a configuration wherein four virtual rod electrodes comprising multiple electrode plates arranged in the ion optical axis C direction are arranged in parallel so as to surround the ion optical axis C, but the configuration of the first ion guide 5 is not limited thereto.

An octapole type second ion guide 8 in which eight rod electrodes are arranged around the ion optical axis C is disposed inside the second intermediate vacuum chamber 7, and due to the effect of the high frequency magnetic field formed by this second ion guide 8, the ions are fed through ion pass-through hole 9 into analytical chamber 10. The configuration of the second ion guide 8, just like that of the first ion guide 5, is not limited to that shown in FIG. 1.

A so-called triple quadrupole mass spectrometer is arranged inside the analytical chamber 10. Namely, a collision cell 12 for dissociating precursor ions and generating various product ions is arranged between a first stage quadrupole mass filter 11 (corresponding to the front end mass analyzer of the present invention) and a third stage quadrupole mass filter 16 (corresponding to the back end mass analyzer of the present invention), and a second stage quadrupole 13 which does not have a mass separation function is disposed inside the collision cell 12. Except for the ion injection hole and ion ejection hole provided on the ion optical axis C, the collision cell 12 is almost entirely sealed, and is supplied with CID gas from outside through a gas supply tube 14 in the middle of which is provided a gas supply valve 15. Furthermore, a detector 17 for detecting arriving ions is arranged on the exit side of the third stage quadrupole mass filter 16. The detection signal from detector 17 is inputted into data processing unit 20, and a mass spectrum, etc. is generated in the data processing unit 20 based on the detection signal obtained during analysis.

A first vacuum gauge 31 which detects the degree of vacuum (gas pressure) is installed inside the first intermediate vacuum chamber 4, and a second vacuum gauge 32 which similarly detects the degree of vacuum (gas pressure) is installed inside the analytical chamber 10, and the pressure values detected by the two vacuum gauges 31 and 32 are inputted into gas pressure determination unit 34 of control unit 33. A Pirani gauge, for example, can be used as the first vacuum gauge 31 which measures the degree of vacuum of low vacuum states, and an ion gauge, for example, can be used as the second vacuum gauge 32 which measures the degree of vacuum of high vacuum states. A display unit 35 and input unit 36 are connected to control unit 33, which comprises a CPU, etc., and this control unit 33 has the function of controlling the various units during analysis.

Typical MS/MS analysis operation in the mass spectrometry apparatus of this example of embodiment will be described in simplified fashion.

A liquid sample containing the sample component to be analyzed is charged and sprayed into ionization chamber 1 through electro spray nozzle 2, and the ions generated as a result are carried through heated capillary 3 into the first intermediate vacuum chamber 4. Furthermore, the effect of the magnetic field generated by the first and second ion guides 5 and 7 causes the ions to be fed into the high degree of vacuum area of the second intermediate vacuum chamber 7 and analytical chamber 10. In the analytical chamber 10, ions are introduced into the space extending in the long axis direction of quadrupole mass filter 11, and due to the effect of the magnetic field formed by the direct current voltage and high frequency voltage applied to quadrupole mass filter 11, only ions having a specific mass-charge ratio (precursor ions) pass through quadrupole mass filter 11 and are introduced into collision cell 12.

CID gas is filled into collision cell 12, the precursor ions come into contact with the CID gas, and split due to collision induced dissociation, creating various product ions. Product ions which have exited the collision cell 12 are introduced into the space extending in the long axis direction of quadrupole mass filter 16, and due to the effect of the magnetic field formed by the direct current voltage and high frequency voltage applied to quadrupole mass filter 16, only product ions having a specific mass-charge ratio pass through the quadrupole mass filter 16 and arrived at the detector 17. For example, by fixing the mass-charge ratio of ions passing through the first stage quadrupole mass filter 11 and scanning the mass-charge ratio of ions which pass through the third quadrupole mass filter 16 in a predetermined range, it is possible to generate a mass spectrum of the product ions corresponding to specific precursor ions in the data processing unit 20 which receives the detection signal from detector 17.

Figure 2:
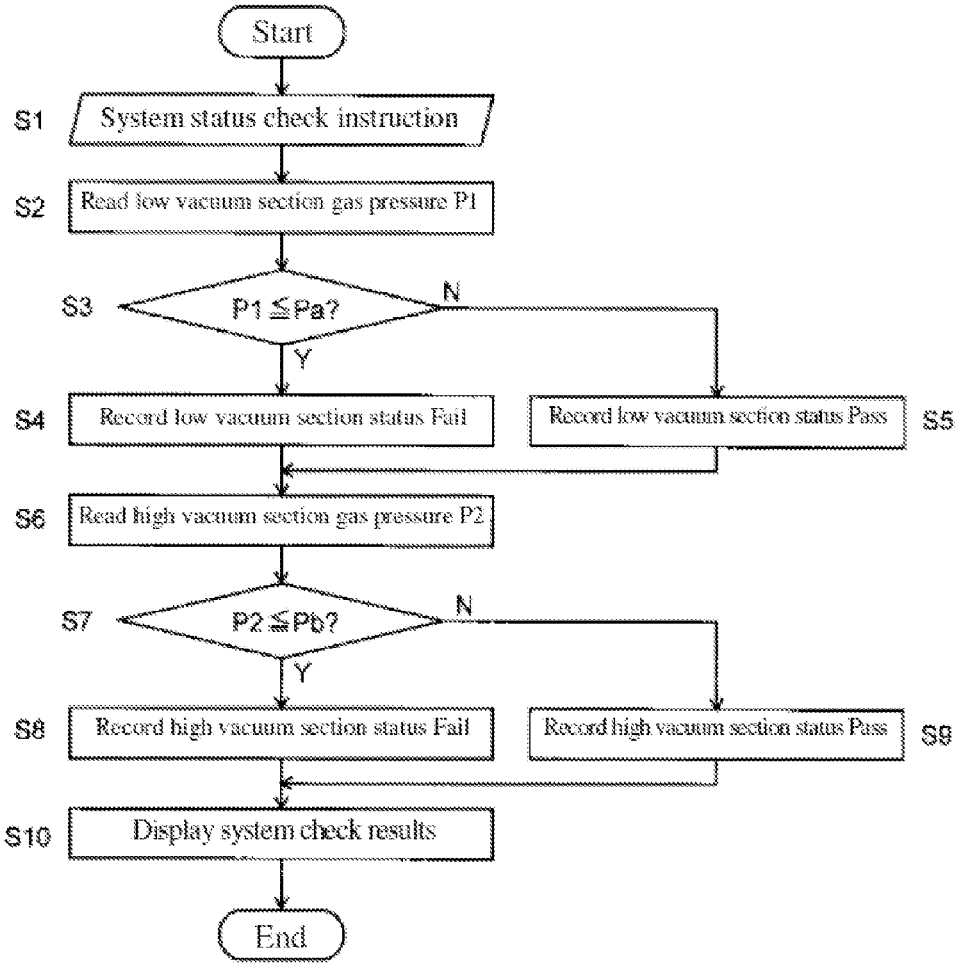
FIG. 2 A flow chart showing the system check control sequence in an MS/MS type mass spectrometry apparatus according to the present example of embodiment.

In the mass spectrometry apparatus of the present example of embodiment, a characteristic system check operation is executed at the request of the analyst (user) prior to executing MS/MS analysis as described above. FIG. 2 is a flow chart showing the control operation for this system check.

If the analyst instructs the execution of a system check by performing a predetermined operation on input unit 36 prior to execution of MS/MS analysis (step S1), gas pressure determination unit 34 of control unit 33, having receiving this instruction, reads in the gas pressure P1 detected by first vacuum gauge 31 inside the first intermediate vacuum chamber 4 (step S2), and determines if this gas pressure P1 is at or below a preset low vacuum side threshold value Pa (step S3). The low vacuum side threshold value Pa and the subsequently described high vacuum side threshold value Pb can be either values preset by the manufacturer of the apparatus or values set in advance by the user through input unit 36. If P1≤Pa in step S3, it is judged that the gas pressure in the first intermediate vacuum chamber 4 is too low, and the status of the low vacuum section is recorded as (Fail) (step S4). On the other hand, if P1>Pa, then the status of the low vacuum section is recorded as (Pass) (step S5).

Next, the gas pressure determination unit 34 reads in the gas pressure P2 detected by the second vacuum gauge 32 in analytical chamber 10 (step S6) and determines whether or not that gas pressure P2 is at or below a preset high vacuum side threshold value Pb (step S7). If P2≤Pb, it is judged that the gas pressure in the analytical chamber 10 is too low, and the status of the high vacuum section is recorded as (Fail)

(step S8). On the other hand, if P2>Pb, then the status of the high vacuum section is recorded as (Pass) (step S9).

Finally, the gas pressure determination unit 34 displays the low vacuum section status check results obtained in steps S4 and S5 and the high vacuum section status check results obtained in steps S8 and S9 on the screen of display unit 35 (step S10). Namely, it is displayed on the screen of display unit 35 whether the status of the low vacuum side gas pressure inside the first intermediate vacuum chamber 4 is (Fail) or (Pass), and whether the status of the high vacuum side gas pressure inside the analytical chamber 10 is (Fail) or (Pass). Furthermore, these check results may also be printed out as a report if necessary. The analyst views these displayed results to verify the initial status of the system.

For example, if the supply of CID gas into the collision cell 12 through the gas supply tube 14 stagnates, the gas flow rate from collision cell 12 to the outside (into analytical chamber 10) will decrease, and thus the degree of vacuum inside the analytical chamber 10 will tend to become too high. Furthermore, if the CID gas supply rate into the collision cell 12 decreases, dissociation of ions will occur less readily in the collision cell 12, the product ion production rate will decrease and the product ion detection sensitivity will fall. Thus, if the check results are that the high vacuum side gas pressure status is (Fail), the analyst would check the areas of the apparatus relating to CID gas supply. Specifically, the CID gas supply pressure, the presence of gas leaks in the gas supply tube 14, the operation of the gas supply valve 15 and the like are the areas to be checked.

Furthermore, if the heated capillary 3 becomes clogged and the inflow of gas into the first intermediate vacuum chamber 4 from the ionization chamber 1 decreases, the degree of vacuum inside the first intermediate vacuum chamber 4 will tend to become too high. If the heated capillary 3 becomes clogged, the quantity of ions flowing in together with the gas will itself decrease, and as a result, the detection sensitivity of the detector 17 will fall. Thus, when the check result is that the low vacuum side gas pressure status is (Fail), the analyst should check for the presence of clogging of the heated capillary 3.

In the mass spectrometry apparatus of the present example of embodiment, as described above, by executing a system check prior to execution of analysis, the analyst can find out in advance about problems of the apparatus relating to CID gas supply, maintenance problems, clogging of the heated capillary 3, etc. As a result, it becomes possible to avoid the useless execution of analysis in a condition where adequate signal strength cannot be obtained.

It will be noted that in the above example of embodiment, in the system check, it was only determined if the gas pressure is too low, but as stated at the beginning of the present specification, since proper analysis cannot be carried out also when the gas pressure is too high, it is also possible to determine if the gas pressure is in a range between a predetermined upper limit value and lower limit value, and issue a different warning display in the case where the gas pressure is below the lower limit value and in the case where it is above the upper limit value.

Furthermore, in the above example of embodiment, supply problems of the CID gas supplied to the collision cell were determined based on the high vacuum side gas pressure status, but the present invention can be generally applied to mass spectrometry apparatus having a cell (chamber) arranged inside a vacuum chamber having a high vacuum atmosphere and a component whereby gas is introduced from the outside into a specific region and operations are performed on ions. Specifically, it is obvious that the present invention can also be applied in cases where a linear ion trap or a three-dimensional quadrupole ion trap is used, cooling gas is supplied into the ion trap, and the ions are cooled and held temporarily. Furthermore, with respect to the other points, it is obvious that suitable modifications, additions and corrections within the scope of the gist of the present invention are included within the scope of patent claims of the present application.

EXPLANATION OF REFERENCES

1 . . . ionization chamber
2 . . . electrospray nozzle
3 . . . heated capillary
4 . . . first intermediate vacuum chamber
5 . . . first ion guide
6 . . . skimmer
7 . . . second intermediate vacuum chamber
8 . . . second ion guide
9 . . . ion pass-through hole
10 . . . analytical chamber
11 . . . first quadrupole mass filter
12 . . . collision cell
13 . . . second quadrupole
14 . . . gas supply tube
15 . . . gas supply valve
16 . . . third quadrupole mass filter
17 . . . detector
20 . . . data processing unit
21 . . . rotary pump
22, 23 . . . turbomolecular pump
31, 32 . . . vacuum gauge
33 . . . control unit
34 . . . gas pressure determination unit
35 . . . display unit
36 . . . input unit

What is claimed is:

1. A mass spectrometry apparatus with a multistage differential evacuation system, comprising:

an ambient pressure ion source which ionizes a sample in an ambient pressure atmosphere;

a mass analysis unit which separates and detects ions according to mass-charge ratio;

at least one ion transport optical system which transports ions from said ambient pressure ion source to said mass analysis unit;

an ionization chamber which has a near-ambient pressure atmosphere and encloses said ambient pressure ion source;

an analysis chamber which has a high vacuum atmosphere and encloses said mass analysis unit; one or multiple intermediate vacuum chambers which are disposed between said ionization chamber and said analytical chamber and enclose said ion transport optical system;

an ion inlet unit for transporting ions from said ionization chamber to the next stage intermediate vacuum chamber;

a pressure sensor which detects gas pressure inside said next stage intermediate vacuum chamber; and a control unit configured to deem that there is an abnormality in ion introduction via said ion inlet unit upon a determination prior to execution of analysis that the gas pressure detected by said pressure sensor is at or below a predetermined threshold value and to issue an alert.

* * * * *